US008995677B2

(12) United States Patent
Lin et al.

(10) Patent No.: US 8,995,677 B2
(45) Date of Patent: Mar. 31, 2015

(54) ACCESSORY CONTROLLER FOR ELECTRONIC DEVICES

(75) Inventors: Wey-Jiun Lin, Los Altos Hills, CA (US); Kurt Stiehl, San Jose, CA (US); John Benjamin Filson, San Jose, CA (US); Cameron Frazier, San Carlos, CA (US); Stephen P. Zadesky, Portola Valley, CA (US)

(73) Assignee: Apple Inc., Cupertino, CA (US)

( * ) Notice: Subject to any disclaimer, the term of this patent is extended or adjusted under 35 U.S.C. 154(b) by 1327 days.

(21) Appl. No.: 12/203,866

(22) Filed: Sep. 3, 2008

(65) Prior Publication Data

US 2010/0054493 A1 Mar. 4, 2010

(51) Int. Cl.
*H04R 1/10* (2006.01)
*H01H 9/02* (2006.01)
(Continued)

(52) U.S. Cl.
CPC ..... *H04R 1/1041* (2013.01); *H01H 9/0228* (2013.01); *H01H 2003/007* (2013.01); *H01H 2011/0081* (2013.01); *H01H 2221/09* (2013.01); *H04R 5/033* (2013.01)
USPC ..... 381/74

(58) Field of Classification Search
CPC .. H04R 1/1041; H04R 2201/107; H04R 3/12; H04R 5/033; H04R 1/105; H04R 1/1066; H04R 2420/07; H04R 1/08; H04R 1/1016; H04R 1/1083; H04R 2201/109; H04R 1/10; H04R 1/1008; H04R 2201/103; H04R 2205/022
USPC ..... 381/74, 113–118, 111, 77, 79, 384, 381/365, 123, 370, 375, 385, 380, 322, 355, 381/361, 86, 98, 102–109, 96; 455/569.1, 455/575.1; 379/420, 430, 428.01, 433.01, 379/433.06
See application file for complete search history.

(56) References Cited

U.S. PATENT DOCUMENTS 3,052,785 A * 9/1962 Herrmann et al. ..... 200/308
3,436,495 A * 4/1969 Gorike ..... 381/361
(Continued)

FOREIGN PATENT DOCUMENTS

CN 2372858 4/2000
CN 1988096 6/2007
(Continued)

OTHER PUBLICATIONS

"TRS connector" Wikipedia, [online], retrieved Jul. 28, 2008, <http://en.wikipedia.org/wiki/TRS_connector>.

*Primary Examiner* — Lun-See Lao
(74) *Attorney, Agent, or Firm* — Brownstein Hyatt Farber Schreck, LLP

(57) ABSTRACT

Accessories such as headsets for electronic devices are provided. A headset may be provided with a button controller assembly that has user-actuated buttons. The button controller assembly may be formed of housing portions that float with respect to each other. Plastic engagement structures may limit the amount of unimpeded travel that is exhibited by the housing portions. The housing portions may be formed from first and second housings. A rigid frame may be mounted within the second housing. The first housing may flex along its length when the user squeezes the first and second housings together to actuate a desired button. Housings may be formed as double-shot plastic parts having first and second plastics with different properties. Integrated circuits and a microphone may be mounted within the button controller assembly. A nonoperational microphone port may be provided as a visual indicator that the button controller contains a microphone.

20 Claims, 7 Drawing Sheets

(51) Int. Cl.

| | |
|---|---|
| *H01H 3/00* | (2006.01) |
| *H01H 11/00* | (2006.01) |
| *H04R 5/033* | (2006.01) |

(56) References Cited

U.S. PATENT DOCUMENTS

| | | | | |
|---|---|---|---|---|
| 4,479,112 | A * | 10/1984 | Hirsch | 380/52 |
| RE35,536 | E | 6/1997 | Irissou et al. | |
| 5,649,307 | A | 7/1997 | Patino | |
| 5,701,355 | A * | 12/1997 | Brannan et al. | 381/361 |
| 5,812,683 | A * | 9/1998 | Parker et al. | 381/74 |
| 5,898,147 | A | 4/1999 | Domzalski et al. | |
| 6,009,338 | A * | 12/1999 | Iwata et al. | 455/575.4 |
| 6,122,369 | A | 9/2000 | Hwang et al. | |
| 6,271,487 | B1 | 8/2001 | Domzalski et al. | |
| 6,745,014 | B1 | 6/2004 | Seibert et al. | |
| 6,760,456 | B1 * | 7/2004 | Annaratone | 381/306 |
| 6,988,905 | B2 | 1/2006 | Corey et al. | |
| 7,110,799 | B1 | 9/2006 | Willins et al. | |
| 7,166,910 | B2 | 1/2007 | Minervini | |
| 7,349,546 | B2 | 3/2008 | Ganton | |
| 2001/0053228 | A1 | 12/2001 | Jones | |
| 2003/0198355 | A1 | 10/2003 | Hong | |
| 2005/0201568 | A1 | 9/2005 | Goyal | |
| 2005/0272401 | A1 * | 12/2005 | Zatezalo et al. | 455/347 |
| 2006/0009868 | A1 | 1/2006 | Park | |
| 2007/0004472 | A1 | 1/2007 | Gitzinger | |
| 2007/0049103 | A1 | 3/2007 | Kashi | |
| 2007/0178947 | A1 | 8/2007 | Kim | |
| 2007/0225049 | A1 | 9/2007 | Andrada | |
| 2008/0032753 | A1 | 2/2008 | Nho | |
| 2008/0039072 | A1 | 2/2008 | Bloebaum | |
| 2008/0164994 | A1 | 7/2008 | Johnson et al. | |
| 2008/0166003 | A1 * | 7/2008 | Hankey et al. | 381/370 |
| 2009/0179768 | A1 | 7/2009 | Sander et al. | |

FOREIGN PATENT DOCUMENTS

| | | | |
|---|---|---|---|
| CN | 200966132 | | 10/2007 |
| CN | 201018635 | | 2/2008 |
| EP | 1429347 | | 6/2004 |
| EP | 1 542 250 | | 6/2005 |
| EP | 1 986 205 | | 10/2008 |
| WO | 9957937 | A1 | 11/1999 |
| WO | 02/45463 | | 6/2002 |
| WO | 03056790 | A1 | 7/2003 |
| WO | 2008085915 | | 7/2008 |
| WO | 2008085929 | A2 | 7/2008 |

* cited by examiner

ACCESSORY CONTROLLER FOR ELECTRONIC DEVICES

BACKGROUND

This invention relates to electronic devices, and more particularly, to accessories for electronic devices such as accessories with button controllers.

Electronic devices such as computers, media players, and cellular telephones typically contain audio jacks. Accessories such as headsets have mating plugs. A user who desires to use a headset with an electronic device may connect the headset to the electronic device by inserting the headset plug into the mating audio jack on the electronic device. Miniature size (3.5 mm) phone jacks and plugs are commonly used with electronic devices such as notebook computers and media players, because audio connectors such as these are relatively compact.

Stereo audio connectors typically have three contacts. The outermost end of an audio plug is typically referred to as the tip. The innermost portion of the plug is typically referred to as the sleeve. A ring contact lies between the tip and the sleeve. When using this terminology, stereo audio connectors such as these are sometimes referred to as tip-ring-sleeve (TRS) connectors. The sleeve can serve as ground. The tip contact can be used in conjunction with the sleeve to handle a left audio channel and the ring contact can be used in conjunction with the sleeve to handle the right channel of audio.

In devices such as cellular telephones, it is often necessary to convey microphone signals from the headset to the cellular telephone. In arrangements in which it is desired to handle both stereo audio signals and microphone signals, an audio connector typically contains an additional ring terminal. Audio connectors such as these have a tip, two rings, and a sleeve and are therefore sometimes referred to as four-contact connectors or tip-ring-ring-sleeve (TRRS) connectors. When a four-contact connector is used, the sleeve may serve as ground. The tip contact and the outermost ring contact may be used in conjunction with the ground to carry audio for the left and right headset speaker audio channels. The innermost ring contact may be used in conjunction with the ground to carry microphone signals.

Some users may wish to operate their cellular telephones or other electronic devices remotely. To accommodate this need, some modern microphone-enabled headsets feature a button. When the button is pressed by the user, the microphone line is shorted to ground. Monitoring circuitry in a cellular telephone to which the headset is connected can detect the momentary grounding of the microphone line and can take appropriate action. In a typical scenario, a button press might be used to answer an incoming telephone call or might be used skip tracks during playback of a media file.

Conventional button arrangements such as these offer limited functionality.

It would therefore be desirable to be able to provide headsets and other accessories with improved button arrangements.

SUMMARY

Accessories such as headsets are provided that include button controller assemblies. The headsets may each include speakers, a button controller assembly, an audio plug, and wires that interconnect the speakers, button controller assembly, and the audio plug. The button controller assemblies may each be formed from a housing having first and second housing portions.

The first and second housing portions of each button controller assembly may have associated plastic engagement features. For example, the first housing portion may have snaps. A plastic frame may be ultrasonically welded to the second housing portion. When assembled to form a finished unit, the snaps on the first housing may engage rails on the frame. Sufficient clearance may be provided between respective engagement structures to allow the first and second housing portions to float with respect to each other. The first and second housing portions may move unimpeded by the engagement structures up to a given amount of travel. When the given amount of travel is reached, the first housing structure may still flex. This allows the first housing structures to bend inwardly towards the second housing structure and its associated frame when the first and second housing structures are squeezed together by a user to actuate a desired button within the button controller assembly.

Button functionality may be provided by dome switches mounted within the button controller assembly. The housing portions may be formed using a two-shot molding process so that each housing portion may include two different types of plastic. The plastics may have different colors, different textures, different rigidities, or other suitable properties. By using different colors for different regions of the housing, certain portions of the housing may be concealed from view and button regions may be marked.

Elastomeric members within the button controller assembly may be used to help bias the housing portions apart. The elastomeric members may be mounted to opposing ends of the plastic frame. Wires for the headset may be engaged by holes in the plastic frame and crimped metal bands.

Integrated circuits, a microphone, and other circuitry may be mounted within the button controller assembly. The circuitry may be used to detect button actuation events when a user squeezes various portions of the housing together. When a button selection is detected, the circuitry may transmit corresponding signals to the electronic device over the wires of the headset.

Air gaps may be formed at the interfaces between plastic portions in the button controller assembly. For example, a thin slit may be formed where the first and second housing portions meet. Slit-shaped air gaps may also be formed at the intersection between the housing portions and the plastic frame. Because of the presence of these air gaps, sound may reach the microphone in the interior of the button controller assembly without use of a dedicated microphone port.

To help a user determine whether or not the button controller assembly contains a microphone, the outer surface of the button controller assembly housing may be provided with a visual indicator that the button controller assembly contains a microphone. The visual indicator may, as an example, be provided in the form of a nonoperational microphone port. The nonoperational microphone port may have structures that resemble a traditional microphone port such as a metal member with holes. The nonoperational port may be formed by omitting holes through the housing, thereby blocking sound from entering the interior of the housing through the port.

Further features of the invention, its nature and various advantages will be more apparent from the accompanying drawings and the following detailed description of the preferred embodiments.

DETAILED DESCRIPTION

The present invention relates generally to electronic devices and accessories for electronic devices.

A typical accessory may be, for example, a headset that includes a button controller assembly. The button controller assembly may include buttons for controlling operation of the electronic device.

Figure 1:
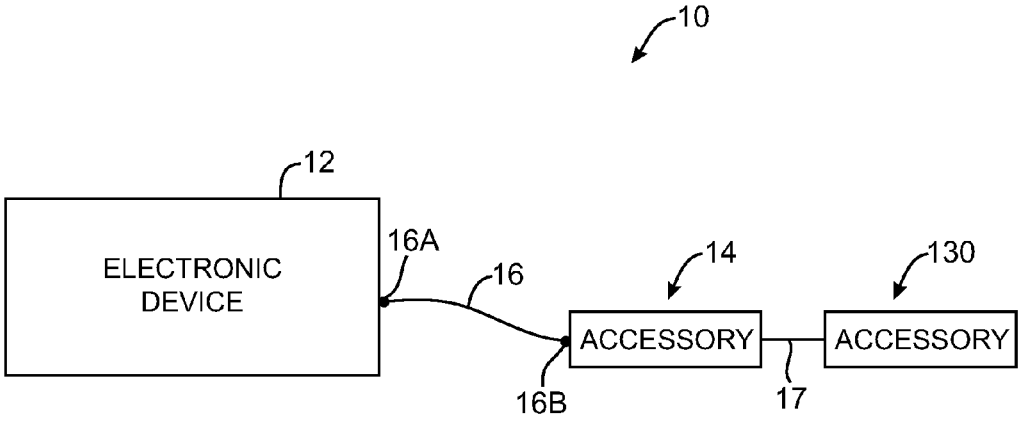
FIG. 1 is a schematic diagram of illustrative accessories in communication with an electronic device in a system in accordance with an embodiment of the present invention.

An illustrative system in which an accessory may be used with an electronic device is shown in FIG. 1. As shown in FIG. 1, electronic device 12 may be coupled to accessory 14 via communications path 16.

Electronic device 12 may be, for example, a device such as a desktop computer or a portable electronic device such as a laptop computer or a small portable computer of the type that is sometimes referred to as an ultraportable. Electronic device 12 may also be a somewhat smaller portable electronic device such as a wrist-watch device, pendant device, or other wearable or miniature device. If desired, electronic device 12 may include wireless capabilities.

Electronic device 12 may be a handheld electronic device such as a cellular telephone, a media player with wireless communications capabilities, a handheld computer (i.e., a personal digital assistant), a remote controller, global positioning system (GPS) devices, a handheld gaming device, etc. Electronic device 12 may also be a hybrid device that combines the functionality of multiple conventional devices. Examples of hybrid electronic devices include a cellular telephone that includes media player functionality, a gaming device that includes a wireless communications capability, a cellular telephone that includes game and email functions, and a portable device that receives email, supports mobile telephone calls, has music player functionality and supports web browsing. Electronic device 12 may also be equipment such as a television or audio receiver, or other suitable electronic equipment. Electronic device 12 may be provided in the form of stand-alone equipment (e.g., a handheld device that is carried in the pocket of a user) or may be provided as an embedded system. Examples of systems in which device 12 may be embedded include automobiles, boats, airplanes, homes, security systems, media distribution systems for commercial and home applications, display equipment (e.g., computer monitors and televisions), etc. These are merely illustrative examples.

Path 16 may include conductive lines (wires) for connecting accessory 14 to electronic device 12. There may be, for example, four conductive lines in path 16 or more lines or fewer lines may be used.

A headset typically includes a pair of speakers that a user can use to play audio from the electronic device. Accessory 14 may be a headset that has a button controller assembly with one or more buttons. When a user actuates buttons on the button controller assembly, circuitry in the button controller assembly may gather button actuation data and may transmit the button actuation data to electronic device 12 over path 16.

As an example, when the user presses a button on the button controller assembly in the accessory, a corresponding signal may be provided to the electronic device to direct the electronic device to take an appropriate action. Because the button is located on the headset rather than on the electronic device, a user may place the electronic device at a remote location such as on a table or in a pocket, while controlling the device using conveniently located headset buttons.

If the electronic device is a media player and is in the process of playing a song or other media file for the user, the electronic device may be directed to pause the currently playing media file when the user presses a button. As another example, if the electronic device is a cellular telephone with media player capabilities and the user is listening to a song when an incoming telephone call is received, actuation of the button by the user may direct the electronic device to answer the incoming telephone call. Actions such as these may be taken, for example, while the media player or cellular telephone is stowed within a user's pocket.

If desired, an accessory with a button controller assembly may be provided in the form of an adapter. As shown in FIG. 1, for example, accessory 14 may be an adapter that provides a user with button control functionality. A conventional stereo headset or other suitable accessory 130 (e.g., an accessory without button functionality or with reduced button functionality relative to accessory 14) may, in turn, be plugged into accessory 14 using communications path 17. Path 17 may be, for example, a three-wire or four-wire path (as examples).

For clarity, aspects of the present invention are sometimes described in the context of accessories such as headsets. This is, however, merely illustrative. The accessories in system 10 may take the form of any suitable equipment that is connected to electronic device 12. Examples of accessories include audio devices such as audio devices that contain or work with one or more speakers. Speakers in accessory 14 may be provided as an earphone or a headset or may be provided as a set of stand-alone powered or unpowered speakers (e.g., desktop speakers). An accessory may, if desired, include audio-visual equipment such as a receiver, amplifier, television or other display, etc. Devices such as these may use paths such as path 16 to receive audio signals from device 12. The audio signals may, for example, be provided in the form of analog audio signals that need only be amplified or passed to speakers to be heard by the user of device 12. An optional microphone in the accessory may pass microphone signals to device 12. Buttons or other user interface devices may be used to gather user input for device 12. The use of these and other suitable accessories in system 10 is merely illustrative. In general, any suitable accessories may be used in system 10 if desired.

Accessories such as headsets are typically connected to electronic devices using audio plugs (male audio connectors) and mating audio jacks (female audio connectors). Audio connectors such as these may be provided in a variety of form factors. Most commonly, audio connectors take the form of 3.5 mm (⅛") miniature plugs and jacks. Other sizes are also sometimes used such as 2.5 mm subminiature connectors and ¼ inch connectors. In the context of accessories such as headsets, these audio connectors and their associated cables are generally used to carry analog signals such as audio signals for speakers and microphone signals. If desired, audio connectors may include optical communications structures to support optical signal traffic.

As shown in FIG. 1, path 16 may be used to connect electronic device 12 and accessory 14 at connections points 16A and 16B. In a typical arrangement, path 16 includes one or more audio connectors such as 3.5 mm plugs and jacks or audio connectors of other suitable sizes at connection points such as points 16A and 16B. Conductive lines in path 16 may be used to convey signals over path 16. There may, in general, be any suitable number of lines in path 16. For example, there may be two, three, four, five, or more than five separate lines. These lines may be part of one or more cables. Cables may include solid wire, stranded wire, shielding, single ground structures, multi-ground structures, twisted pair structures, or any other suitable cabling structures.

In a typical scenario, device 12 may be, as an example, a handheld device that has media player and cellular telephone capabilities. Accessory 14 may be a headset with a microphone and a user input interface such as a button-based interface for gathering user input. Path 16 may be a four conductor audio cable that is connected to devices 12 and 14 using 3.5 mm audio jacks and plugs (as an example).

The audio connectors that are used to interconnect device 12 and accessories such as accessory 14 may include audio plugs that mate with corresponding audio jacks. These connectors may be used at any suitable location or locations within path 16 such as locations 16A or 16B. For example, an audio jack can be formed within the housing of device 12 at location 16A and mating plug on the end of cable 16 may plug into the jack at location 16A.

An example of a suitable audio plug is a four-contact plug. A four-contact plug may have four conductive regions arranged along a cylindrical barrel that mate with four corresponding conductive regions in a four-contact jack. The region at the tip of the plug is sometimes referred to as the tip contact. The region at the opposing end of the plug is sometimes referred to as the sleeve contact. The two interposed regions are sometimes referred to as first and second ring contacts. Using this terminology, four-contact plugs are sometimes referred to as tip-ring-ring-sleeve (TRRS) plugs and their mating jacks are sometimes referred to as TRRS jacks. Jacks and plugs with different numbers of contacts (e.g., fewer than four or more than four) may also be used. In general, audio connectors in path 16 may be formed from any suitable plugs (male connectors) and any suitable jacks (female connectors) or any other suitable mating connectors. Moreover, connectors may be placed at any suitable locations along path 16. With a typical arrangement, a jack is mounted within device 12 and a mating plug is connected to accessory 14 by a cable attached at location 16B. This is, however, merely illustrative. A jack may be mounted in accessory 14 at location 16B and a plug may be connected to device 12 via a cable at location 16A. As another example, jacks may be used in both device 12 and accessory 14 and a double-ended cable (i.e., a cable with male connectors on either end) may be used to connect device 12 with accessory 14. Adapters may also be used. For example, an adapter may be plugged into device 12 (e.g., using a digital port). The adapter, which may be considered to be a type of accessory 14, may be provided with a jack into which a plug from a headset or other equipment may be inserted to complete path 16. In this type of scenario, the adapter may contain circuitry for performing functions that would otherwise be performed by buttons and circuitry on the headset.

Figure 2:
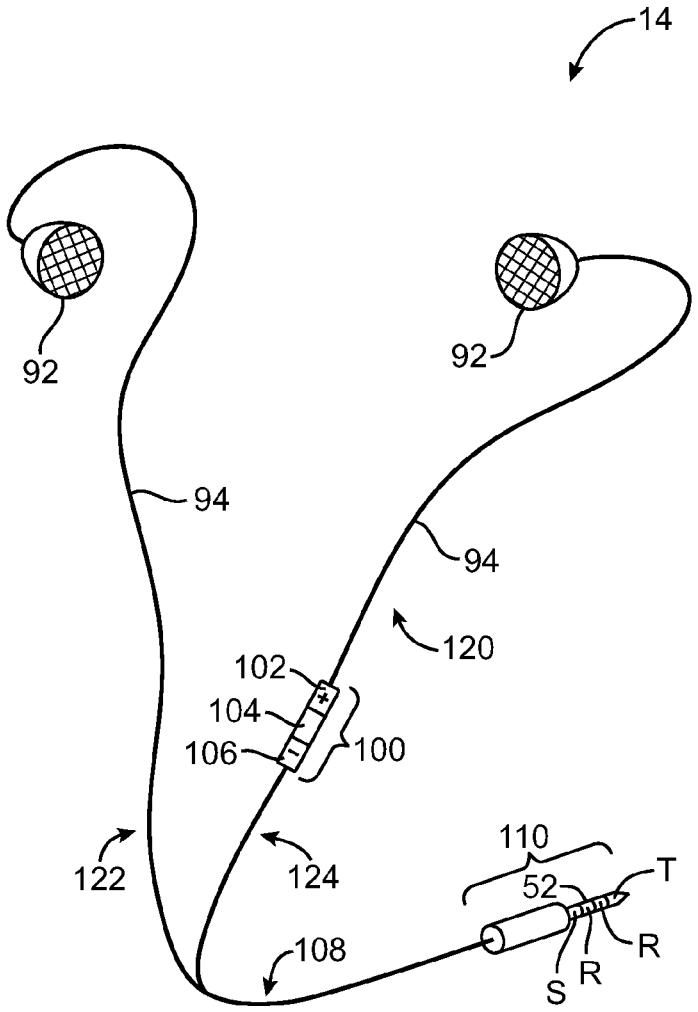
FIG. 2 is a perspective view of an illustrative accessory such as a headset that may be provided with user-selectable buttons in accordance with an embodiment of the present invention.

An illustrative accessory is shown in FIG. 2. Accessory 14 of FIG. 2 is a headset with a microphone. Speakers 92 may be provided in the form of over-the-ear speakers, ear plugs, or ear buds (as examples). Dual-conductor wires such as wires 94 may be connected to speakers 92. Button controller assembly 100 may include a microphone. In some applications, the microphone may not be needed and may therefore be omitted from accessory 14 to lower cost. In other applications, such as cellular telephone application, voice recording applications, etc., the microphone may be used to gather audio signals (e.g., from the sound of a user's voice).

In the FIG. 2 example, button controller assembly 100 includes three buttons. If desired, more buttons, fewer buttons, or non-button user input devices may be included in accessory 14. Moreover, it is not necessary for these devices to be mounted to the same unit as a microphone. The FIG. 2 arrangement is merely illustrative.

In an illustrative three-button arrangement, a first of the three buttons such as button 102 may be pressed by a user when it is desired to advance among tracks being played back by a music application or may be used to increase a volume setting. A second of the three buttons, such as button 104 may be pressed when it is desired to stop music playback, answer an incoming cellular telephone call made to device 12 from a remote caller, or when it is desired to make a menu selection. A third of the three buttons such as button 106 may be selected when it is desired to move to an earlier track or when it is desired to lower a volume setting. Multiple clicks, click and hold operations, and other user input patterns may also be used. The up/down volume, forward/reverse track, and "answer call" examples described in connection with FIG. 2 are merely illustrative. In general, the action that is taken in response to a given command may be adjusted by a system designer through modification of the software in device 12.

As shown in FIG. 2, a cable such as cable 108 may be integrated into accessory 14. At its far end, cable 108 may be provided with a connector such as audio connector 110. In the FIG. 2 example, accessory 14 has two speakers 92 and a microphone. Connector 110 may therefore be of the four-contact variety (i.e., a TRRS plug). In accessories in which the microphone or one of the speakers is omitted, signals can be carried over fewer lines (e.g., using a three-contact connector). If desired, connectors with additional contacts may also be used (e.g., to carry auxiliary power, to carry control signals, etc.). Audio connectors with optical cores can be used to carry optical signals in addition to electrical signals.

Accessory 14 may be provided with circuitry that helps convey signals from button controller unit 100 to device 12 over path 16. In general, any suitable communications format may be used to convey signals (e.g., analog, digital, mixed arrangements based on both analog and digital formats, optical, electrical, etc.). These signals may be conveyed on any suitable lines in path 16. To avoid the need to provide extra conductive lines in path 16 and to ensure that accessory 14 is as compatible as possible with standard audio jacks, it may be advantageous to convey signals over existing lines (e.g., speaker, microphone, and ground). In particular, it may be advantageous to use the microphone and ground lines (e.g., the lines connected to contacts such as ring contact 52 and sleeve S in audio plug 110) to convey signals such as user input signals and control signals between accessory 14 and electronic device 12.

With one suitable communications arrangement, buttons such as buttons 102, 104, and 106 may be encoded using different resistances. When a user presses a given button, device 12 can measure the resistance of user input interface 100 over the microphone and ground lines and can thereby determine which button was pressed. With another suitable arrangement, a button may be provided that shorts the microphone and ground wires in cable 108 together when pressed. Electronic device 12 can detect this type of momentary short. With yet another suitable arrangement, button presses within interface 100 may be converted to ultrasonic tones that are conveyed over the microphone and ground line. Electronic device 12 can detect and process the ultrasonic tones. These are merely illustrative examples. Any suitable communications circuitry may be provided in button controller assembly 100 to support communications between accessory 14 and device 12 if desired.

Moreover, electronic device 12 can support communications using two or more communications arrangements. Different approaches may be used, for example, to support both legacy hardware and new hardware, to support different types of software applications, to support reduced power operation in certain device operating modes, etc.

In the example of FIG. 2, button controller assembly 100 is located between path portion 124 and path portion 120. In this type of arrangement, path 124 may contain four wires (for left audio, right audio, microphone, and ground), whereas path portion 120 may contain two wires (for ground and right audio). Path portion 122 may contain two wires (for ground and left audio). This is merely one illustrative example. Button controller assembly 100 may be located on any suitable portion of the wiring in accessory 14 if desired. For example, button controller assembly 100 may be placed at an intermediate location along path segment 108, rather than between path segments 120 and 124 as shown in the example of FIG. 2.

Figure 3:
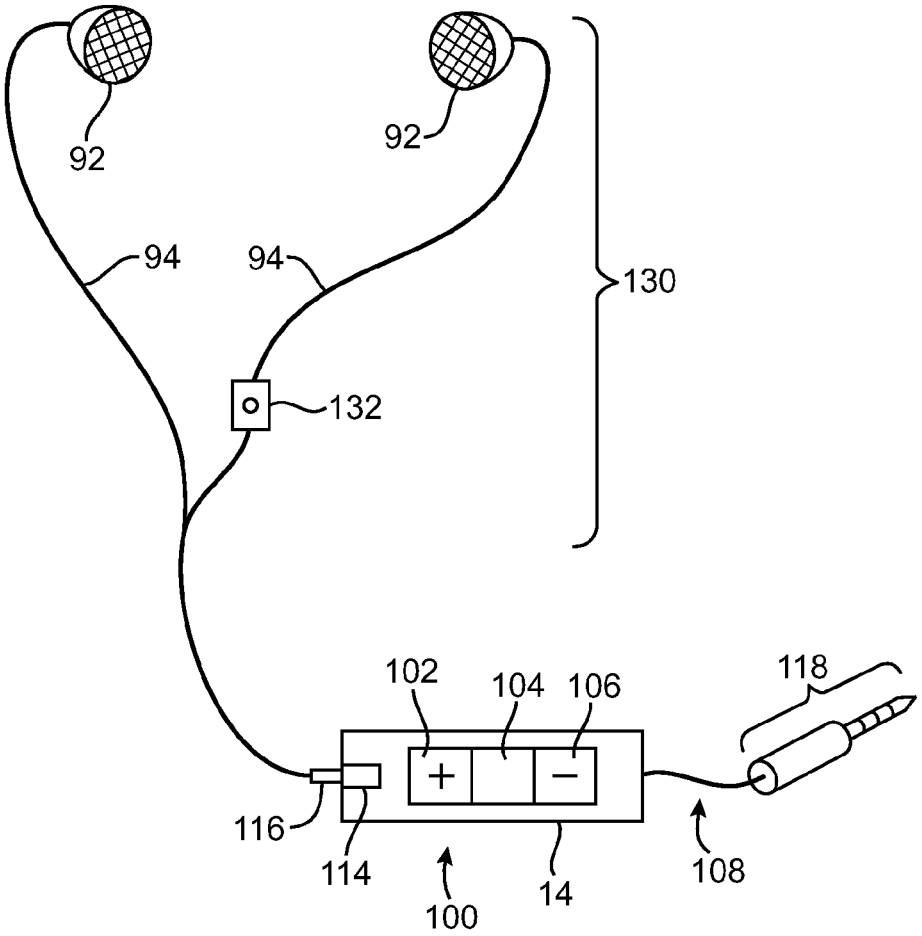
FIG. 3 is a perspective view of an illustrative accessory such as a headset that has been connected to an adapter accessory having user-selectable buttons in accordance with an embodiment of the present invention.

FIG. 3 shows how accessory 14 may be provided in the form of an adapter that allows button functionality to be added to an accessory 130 that does not necessarily include button functionality. As shown in FIG. 3, headset 130 may have an audio plug 116 that plugs into a mating audio jack 114 on adapter accessory 14. Plug 116 and jack 114 may be audio connectors such as tip-ring-sleeve (TRS) or TRRS connectors. Headset 130 may include speakers 92, conductive paths 94 and optional components 132 (e.g., for a legacy button or microphone).

Adapter accessory 14 may include electrical paths that pass audio signals from device 12 to speakers in headset 130 and that pass microphone signals from a microphone to device 12 (e.g., a microphone in adapter 14 or in component 132). Adapter 14 may also include the circuitry that handles communications with device 12 over path 16 that would otherwise be included within the button controller assembly of a headset accessory. It is therefore not necessary for headset 130 in the FIG. 3 arrangement to include this circuitry. In the FIG. 3 example, headset 130 includes speakers 92 and may include microphone 132, but need not include any buttons, because buttons 102, 104, and 106 are included on accessory 14. Accessory 14 may have a cable such as cable 108 with an audio connector 118 for plugging into a mating audio jack on device 12. Adapter-type arrangements such as the arrangement of FIG. 2 allow a user to add button functionality to an accessory such as a headset that does not include buttons. This may be particularly advantageous if a user already owns several different styles of buttonless headset, yet desires to use buttons such as buttons 102, 104, and 106 to control electronic device 12 remotely. If desired, an adapter accessory such as accessory 14 of FIG. 3 may be provided with a microphone.

Figure 4:
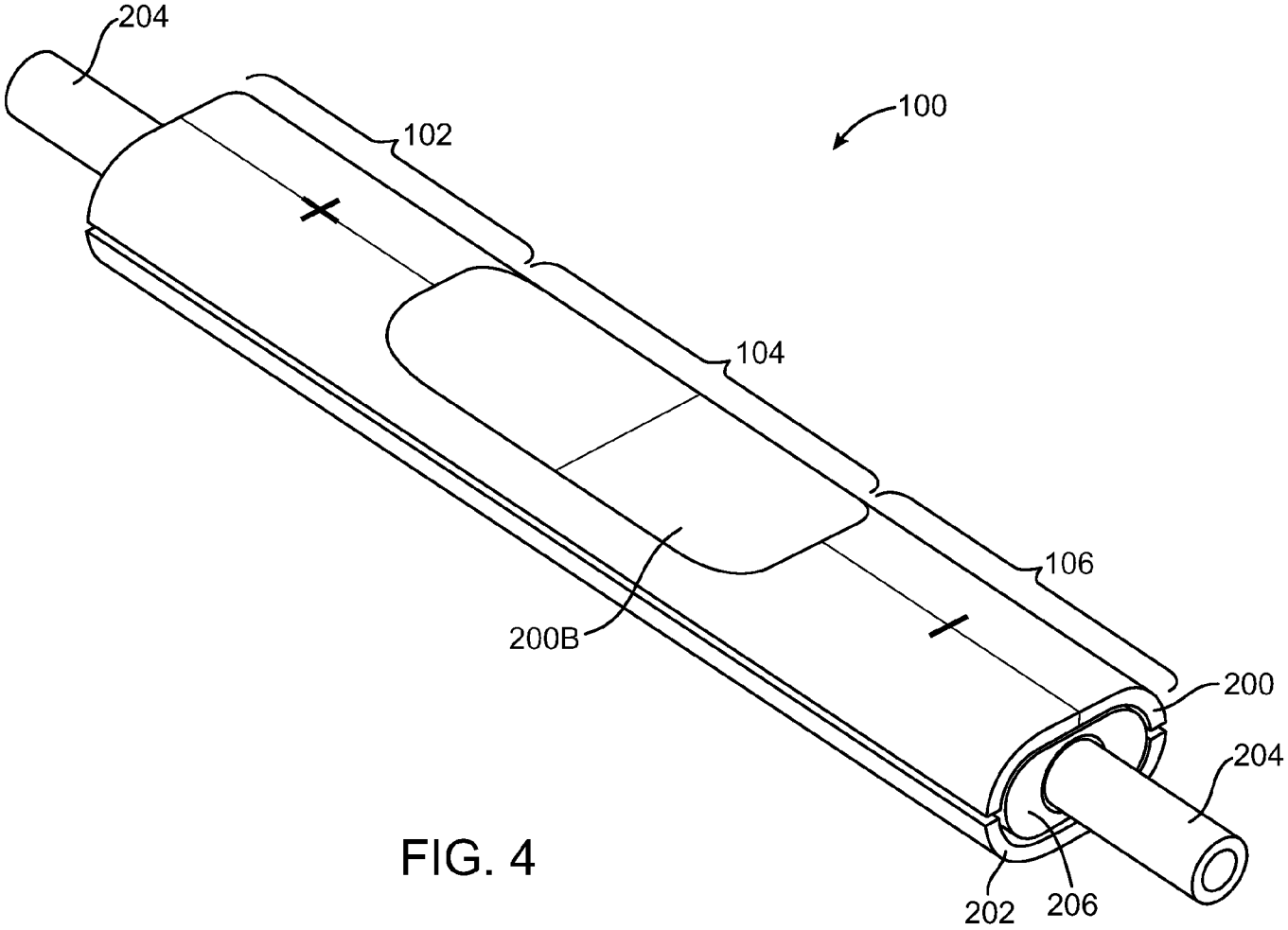
FIG. 4 is a perspective view showing the upper surface of an illustrative button controller assembly for controlling operation of an electronic device in accordance with an embodiment of the present invention.

Any suitable form factor may be used for button controller assembly 100. An illustrative example is shown in FIG. 4. As shown in FIG. 4, button controller assembly 100 may be formed using an elongated housing structure. The housing may have multiple parts. For example, the housing for button controller assembly 100 may have an upper portion such as portion 200 and a lower portion such as portion 202. Cable 204 may protrude from either end of button controller assembly 100.

In the FIG. 4 example, button controller assembly 100 contains three button regions. Button region 102 has been labeled "+" to indicate to the user that this region forms a button that may be pressed when it is desired to increase a playback volume or take other such appropriate actions. Button region 104 may be used in forming a button that performs functions such as pausing playback or other suitable actions. Button region 106 has been labeled "–" to indicate to the user that button region 106 forms a button that may be pressed when it is desired to decrease a playback volume or take other appropriate actions.

Upper housing portion 200 and lower housing portion 202 may be attached to internal structures. For example, upper housing portion 200 and lower housing portion 202 may be rigidly or movably connected to a frame such as frame 206. Frame 206 may have structures that engage cable 204 and that help support housing sections 200 and 202.

Housing portions 200 and 202 and frame 206 may be formed from any suitable material. As an example, some or all of housing portions 200 and 202 and frame 206 may be formed from plastic such as a blended plastic formed from polycarbonate and acrylonitrile butadiene styrene (i.e., PC/ABS plastic). With one suitable arrangement, housing portions 200 and 202 may be formed from multiple shots of plastic. For example, housings 200 and 202 may be formed using a double shot molding process. With this type of arrangement, different portions of each housing may be formed from different plastics. This allows different portions of each housing to be provided with individually tailored materials properties. These properties may include, for example, different textures, different colors, different rigidities (i.e., different flexibilities), different durability levels, etc.

As an example, it may be desired to form the portion of housing 200 such as the portion in region 104 from a plastic that is more textured than the plastic in regions 102 and 106. This may help the user of button controller interface 100 recognize when the user's finger is on top of region 104. As shown in FIG. 4, the surface of housing 200 in region 104 may also be recessed with respect to the surface of housing 200 in regions 102 and 106 to facilitate user identification of each button region.

As another example, snaps and other features on the interior portions of housings 200 and 202 may be formed from plastics that are more rigid than other housing portions. With this type of approach, some structures may be formed from a plastic that is flexible enough to deform under user finger pressure, while other structures (e.g., snaps and other interior engagement structures) may be rigid enough to exhibit desired levels of durability and strength.

The housings, frame, and other structures of button controller assembly 100 may be configured to allow housing portions 200 and 202 to float relative to each other when a user actuates a desired button. One or both housing portions may also flex along their lengths. When floating, structures in the housings are captured by each other which limits the maximum amount of permissible travel. As an example, a snap feature may protrude into a hole or be captured by a rail. The housings can float (freely move) with respect to each other, so long as the snap does not bear against the edges of the hole or rail. Once the snap bears against a hole or rail edge (in this example), the maximum amount of permissible travel has been reached and further travel will be impeded. Housing portions that flex allow additional flexing movement beyond what would be permitted solely by the "float" between the housing portions.

With one illustrative configuration, upper housing 200 and frame 206 may be rigidly attached to each other, whereas lower housing 202 may be allowed to move relative to upper housing 200 (i.e., float) when a user squeezes a desired one of the buttons formed by regions 102, 104, and 106. Lower housing 200 may also flex somewhat when a user squeezes assembly 100 by pressing a desired one of the buttons. This flexibility can help accommodate selection of an individual button without inadvertently activating other buttons.

Figure 5:
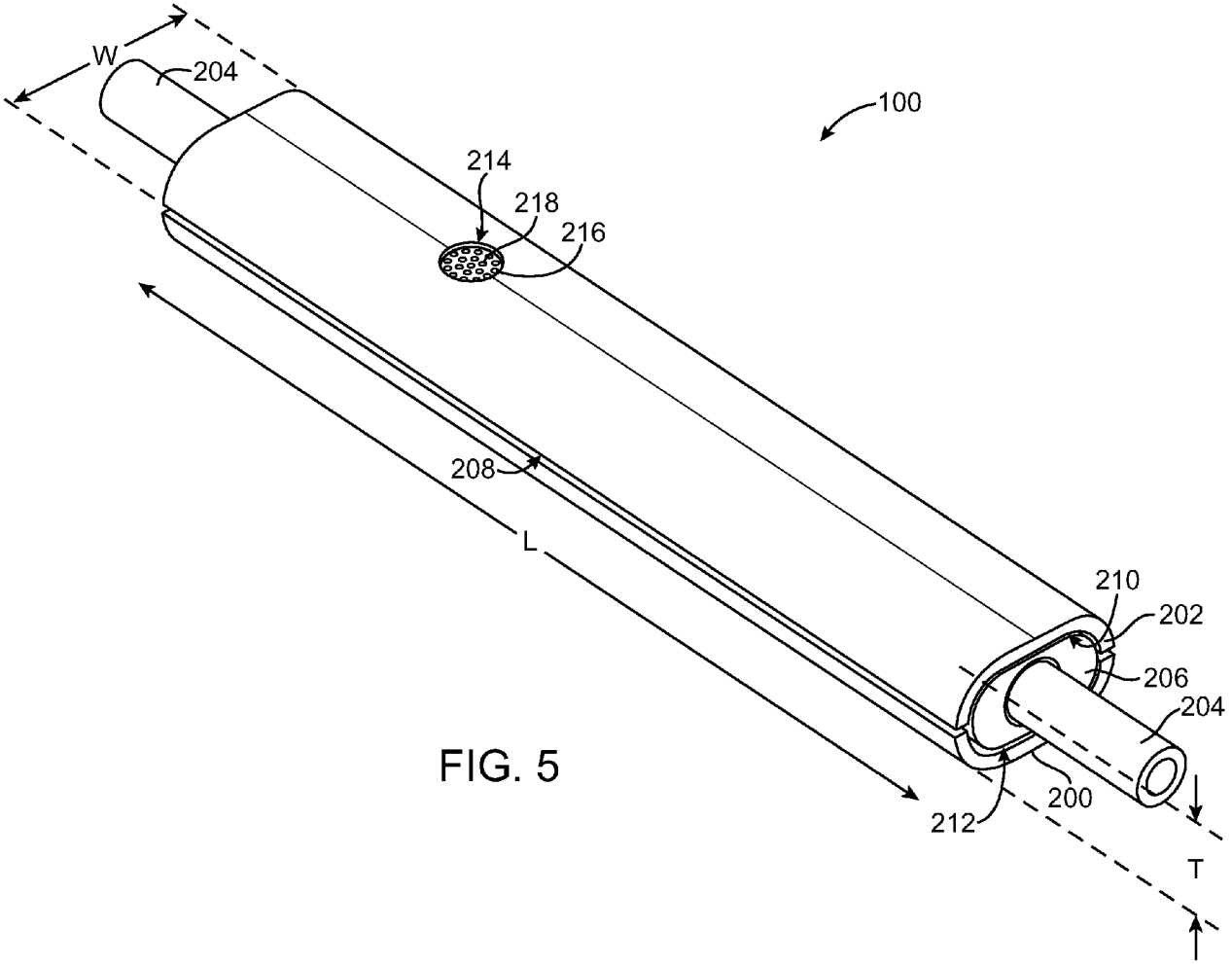
FIG. 5 is a perspective view showing the lower surface of an illustrative button controller assembly for controlling operation of an electronic device in accordance with an embodiment of the present invention.

As shown in the perspective view of FIG. 5, button controller assembly 100 may have a length L that is greater than its width W and thickness T. In an illustrative configuration, length L may be about 28 mm, width W may be about 5.19 mm, and thickness T may be about 3.34 mm. The thickness of housing 200 may be about 0.4 mm and the thickness of housing 202 may be about 0.4 mm. Cable 204 may have a diameter of about 1.6 mm.

Button controller assembly 100 may include a microphone. Because there are generally air gaps between the various housing members and other structures in assembly 100, it is typically possible for sound to reach the interior of button controller assembly 100 without providing a separate microphone port. As a result, button controller assembly 100 may, if desired, be provided with no specialized microphone port. Sound from the exterior of assembly 100 may reach the interior of assembly 100 through air gaps such as air gap 208 between housing 202 and housing 200, air gap 210 between housing 202 and frame 206, and air gap 212 between housing 200 and frame 206. These gaps may be present at both ends of assembly 100 and on either side of assembly 100. When gaps such as these are present, the microphone in assembly 100 may be mounted in the interior of assembly 100 without providing additional holes in housings 200 and 202.

Although it is possible to mount a microphone within assembly 100 without providing a dedicated microphone port, it is possible that a user of button controller assembly 100 might become confused as to whether button controller assembly 100 contains a microphone. To avoid user confusion, it may therefore be desirable to provide button controller assembly 100 with a visual indicator that informs the user of the presence of the microphone.

In the example of FIG. 5, lower housing 202 has been provided with a nonoperational microphone port 214 that serves as a visual indicator of the presence of a microphone within button controller assembly 100. Port 214 may be provided with a perforated metal disk such as disk 218. Housing 202 may be provided with a circular recess into which disk 218 may be mounted. Circular recess 216 and disk 218 may each have a diameter of about 1.57 mm (as an example). Disk 218 may be formed from a metal plate (e.g., stainless steel) that is about 0.1 mm in thickness and that has holes of about 0.209 mm in diameter. The holes may be formed in disk 218 by chemical etching or other suitable fabrication techniques. If desired, disk 218 may be formed from a wire mesh or a fabric.

Disk 218 may be mounted within circular recess 216 using double-sided adhesive film (tape). Circular recess 216 may have a closed bottom with no holes, so sound does not flow through port 214. In this type of configuration, port 214 is not functional as a microphone port, but serves instead as a visual indicator to the user that a microphone is present within button controller assembly 100. If desired, a functional microphone port that includes a wire mesh may be provided in assembly 100 in addition to or instead of nonoperational port 214. Moreover, other types of visual indicators may be used to indicate to the user that the microphone is present in button controller assembly 100. For example, a printed shape in the form of a label, a microphone symbol, or a microphone port may be provided on the exterior of the housing of assembly 100. A suitable visual indicator may also be provided by using an appropriately colored plastic portion within the housing of assembly 100 or other visual indicators may be used.

Figure 6:
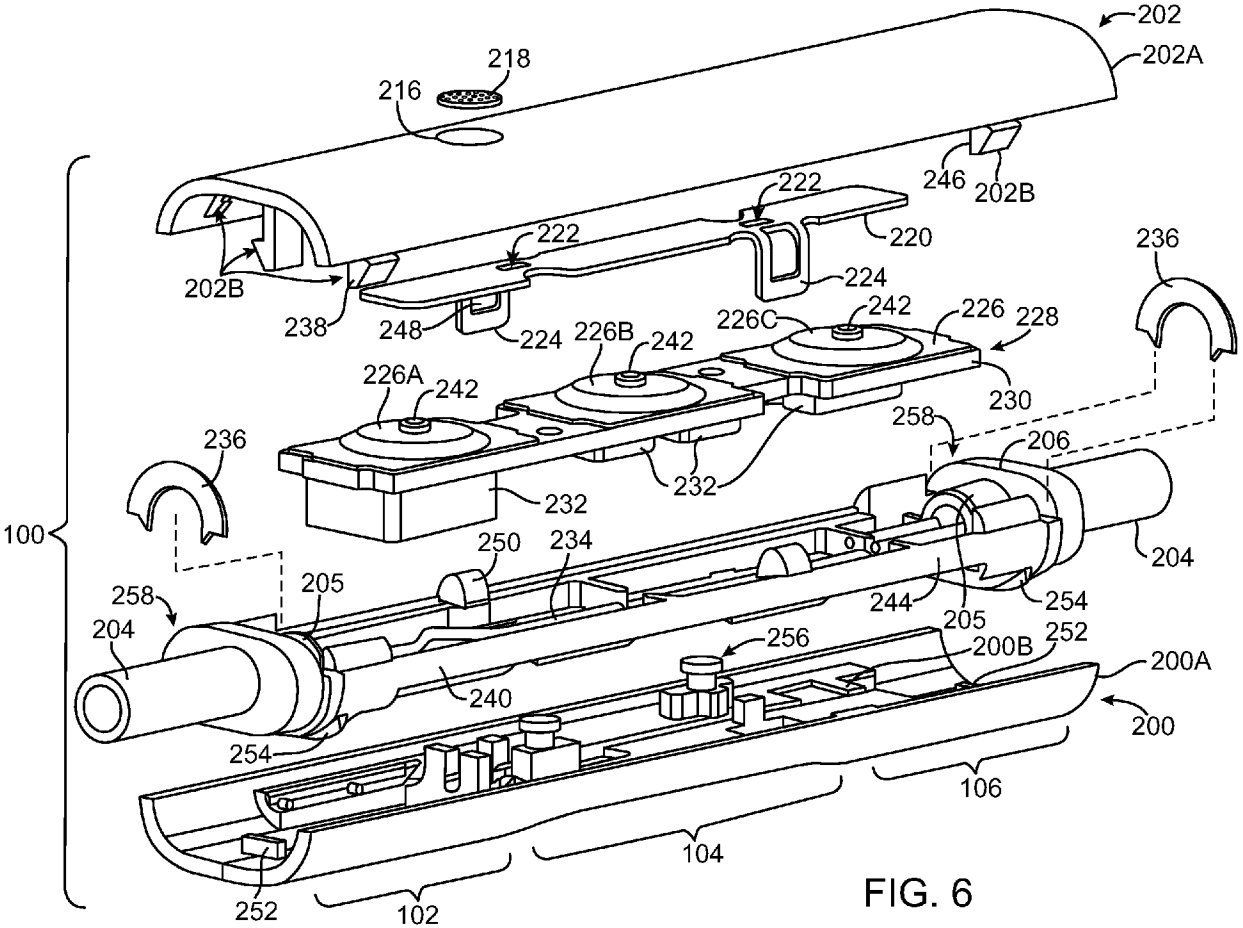
FIG. 6 is an exploded perspective view of an illustrative button controller assembly for controlling operation of an electronic device in accordance with an embodiment of the present invention.

FIG. 6 shows an exploded perspective view of button controller assembly 100. As shown in FIG. 6, lower housing 202 may be formed from two different types of plastic using a two-shot injection molding process. A first plastic may be used to form housing portion 202A. A second plastic may be used to form housing portion 202B. Portion 202B may, for example, be formed from a more durable and less flexible plastic than portion 202A. This may help to allow portion 202A to flex along its length when pressed by a user, while ensuring that portions 202B are sufficiently rigid to serve as engagement structures. If desired, portions 202A and 202B may be formed from plastics that have similar or equal rigidities.

Plastic portions 202A and 202B may have different textures or colors. A darker color may be preferred for portions 202B, because these portions of housing 202 may be visible through the air gaps in the housing (e.g., air gaps 210 and 212 of FIG. 5) when button controller assembly 100 is fully assembled. Portions 202B may be configured to form snaps or other engagement structures that help to attach housing 202 to button assembly 100.

Center snap member 220 may be formed of a material such as metal. An example of a suitable metal for member 220 is stainless steel. Stainless steel or other such materials may be used for member 220 so that member 220 may serve as a durable surface against which button switches may bear during operation of button controller assembly 100.

Holes 222 in member 220 may mate with corresponding heat stake portions on the inside of housing 202. Member 220 may be attached to housing 202 by melting the outermost portions of the heat stakes after holes 222 have been placed over the heat stakes. Tabs 224 may have holes that engage snaps or other engagement structures that are part of housing 200 or that are attached to housing 200. For example, housing portion 200 and frame 206 may be rigidly connected to each other so that frame 206 becomes a part of housing portion 200 and holes in tabs 224 of member 220 such as hole 248 may mate with corresponding snaps or other engagement features on frame 206 such as snap 250.

Dome switch assembly 228 may be used to provide button controller assembly 100 with user-controllable button switches. As shown in FIG. 6, dome switches 226 such as dome switches 226A, 226B, and 226C may be mounted on printed circuit board 230. Integrated circuits and other circuitry 232 such as a microphone may be mounted on the opposite side of printed circuit board 230. Circuitry 232 may be electrically connected to dome switches 226. When button controller assembly 100 is assembled, switch 226A is longitudinally and laterally aligned with region 102 and switches 226B and 226C are aligned with regions 104 and 106 respectively. When a user squeezes a given region, the corresponding portion of housing 202 is pressed inwardly. As this portion of housing 202 moves inwardly, a corresponding portion of member 220 is forced against the nub on an appropriate one of dome switches 226. Because member 220 is formed of metal (in one suitable arrangement), the nub will not dig into member 220 over time, as might occur if the nub were to bear against a soft plastic.

Nubs 242 may, if desired, be coated with a durable material such as epoxy to help ensure crisp switch actuation events. Dome switches 226 may each have a circular metal dome portion on which a nub is formed. The metal domes may be held in place on dome switch assembly 226 using clear tape. On their inner surfaces, the dome switches may have traces that connect to corresponding traces in the printed circuit board 230. Adhesive film may be used to attach the dome switches to printed circuit board 230.

To ensure that the dome switch will be actuated when the user squeezes assembly 100, the snaps and other engagement features that are used to attach the various portions of assembly 100 together may be provided with sufficient clearances to allow housing 202 to float (travel) unimpeded. The maximum permitted amount of travel between the two floating pieces of assembly 100 may be, for example, 0.15 mm to 0.2 mm in the vertical direction.

If the user presses region 104 (as an example), the central region of housing 202 will be forced inward against switch 226B to actuate switch 226B. During actuation, housing 202 travels inwardly towards frame 206 and housing 200. Housing 202 also preferably flexes, so that the ends of housing 202 (and therefore the associated end portions of member 220) are not pressed significantly inwards while the central region of housing 202 travels inward. This is accomplished by ensuring that dome switches 226A and 226B and structures 256 of housing portion 200B press outwardly with sufficient force to resist the inward movement of housing 202 that is produced while the central portion of housing 202 is being pressed inwardly against switch 226B. As this example demonstrates, button housing 220 preferably has both a free range of travel that results from using snaps and other engagement features that do not rigidly attach housing 202 to frame 206 and a flexibility that accommodates individual button selections without inadvertently actuating more than one dome switch 226 at a time.

Spring members such as spring members 236 may be provided to help bias housing 202 outwardly away from frame 206 and housing 200. Spring members 236 may be formed from any suitable material. As an example, spring members 236 may be formed from an elastomeric material such as silicone and may therefore sometimes be referred to as rubber gaskets. Spring members 236 may fit into recesses within frame 206, straddling cable 204. The outermost portions of spring members 236 may be curved so that they press evenly against the inner surface of housing portion 202A. Spring members 236 may be located at the ends of assembly 100 or any other suitable locations along the length of assembly 100. Particularly when located at the ends of assembly 100, spring members 236 may serve as cosmetic shrouds by helping to shield the interior portion of assembly 100 from view. Any suitable number of spring members 236 may be used in assembly 100 (e.g., one, two, three, more than three, etc.).

Circuitry 232 may detect which dome switch is actuated by the user and may transmit corresponding signals to device 12 over wires in cable 204. As shown in FIG. 6, some of the wires in cable 204 such as wire 234 pass through button controller assembly 100 (i.e., to route speaker signals to a speaker), whereas other wires may be soldered onto pads on printed circuit board 230. Metal crimp structures such as crimp bands 205 may be crimped to the ends of cable 204, to prevent cable 204 from being withdrawn from frame 206.

When fully assembled, portions 202B of housing 202 may engage portions of frame 206. For example, snap 238 may engage rail portion 240 of frame 206 and snap 246 may engage rail portion 244 of frame 206. Member 220 may be heat staked to housing 202 and may have tabs 224 with holes that engage with mating features in frame 206. The holes in tabs 224 such as hole 248, the mating engagement feature on frame 206 (e.g., snap 250), and the respective mating engagement features on housing portion 202B and frame 206 are preferably configured to allow vertical travel (e.g., 0.15 mm to 0.2 mm of floating travel) between housing 202 and frame 206 (and thereby housing 200) when a button is actuated. At least some of the engagement features in button controller assembly 100 may be formed exclusively from plastic parts. For example, the plastic engagement structure formed by snap 238 may mate with plastic rail portion 240 without using any metal parts. Structures such as snap 238 may be sufficiently flexible to flex laterally inward during assembly (e.g., by about 0.3 mm to ride over rails such as rail 240 in frame 206).

Frame 206 may be rigidly attached to housing portion 200. Alignment structures 252 may help to longitudinally align frame 206 with housing 200. When properly aligned, ridges 254 on frame 206 run along the inner surface of housing 200 adjacent to alignment structures 252. Ridges 254 may be bonded with housing 200 using ultrasonic welding, thereby forming a unitary structure in which frame 206 rigidly attached to housing 200 and does not travel significantly with respect to housing 200. Although button labels (i.e., the "+," recess, and "–") are provided on upper housing 200 rather than lower housing 200 in the example of FIGS. 4, 5, and 6, during button actuation, housing 202 travels and flexes inwardly against dome switches 226, rather than housing 200. Dome switches 226 are preferably held rigidly against housing 200, so that a desired dome switch nub may be depressed by the user.

Housing 200 may, if desired, be formed from a double shot molding process. This allows portions 200B to be formed from a different plastic than portions 200A. Portions 200B may, for example, be formed from a plastic that is darker in color than portions 200A. This helps to reduce the visibility of portions 200B through air gaps such as gaps 208 and 210 (FIG. 5) and helps to increase the visibility of portion 200B in region 104 on the outermost surface of assembly 100 (as shown in FIG. 4). Features 256 form support structures for integrated circuits 232 and subassembly 228 and structures that bear against the inner portion of housing 202 when squeezed to help separately define button regions 102, 104, and 106. End portions 258 of frame 206 serve as environmental seals and cosmetic covers that help to block the user's view of the interior of button controller assembly 100.

Figure 7:
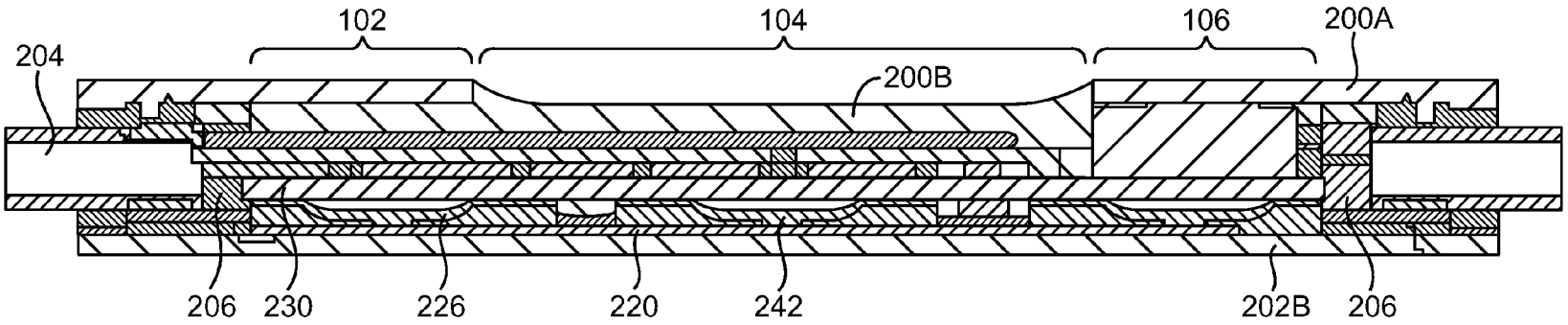
FIG. 7 is a cross-sectional side view of an illustrative button controller assembly for controlling operation of an electronic device in accordance with an embodiment of the present invention.

A cross-sectional side view of button controller assembly 100 of FIG. 5 when assembled for use in system 10 is shown in FIG. 7.

The foregoing is merely illustrative of the principles of this invention and various modifications can be made by those skilled in the art without departing from the scope and spirit of the invention.

What is claimed is:

1. A button controller assembly for a headset of an electronic device, comprising:

first and second housing portions that are configured to float with respect to each other, the first housing portion having a first and second button actuation region;

a first and second switch mounted between the first and second housing portions, wherein each switch is aligned with a respective button actuation region of the first housing portion; and a first cable connecting the button controller assembly to a set of speakers; and a second cable connecting the button controller assembly to a lack, wherein a press on the first button region results in actuation of the first switch, and a press on the second button actuation portion results in actuation of the second switch.

2. The button controller assembly defined in claim 1, wherein the first and second housing portions comprise plastic.

3. The button controller assembly defined in claim 1 further comprising:

a microphone in an interior portion of the button controller assembly; and a visual indicator on at least one of the housing portions that visually indicates presence of the microphone within the interior portion of the button controller assembly.

4. The button controller assembly defined in claim 3 wherein the visual indicator comprises a nonoperational microphone port.

5. The button controller assembly defined in claim 4 wherein the nonoperational microphone port comprises structures that appear to be a microphone port while blocking sound from entering the interior portion of the button controller assembly.

6. The button controller assembly defined in claim 4 wherein the nonoperational microphone port comprises a metal disk with holes mounted on top of plastic without holes.

7. The button controller assembly defined in claim 6 wherein the first housing portion has a circular recess without holes within which the metal disk is mounted.

8. The button controller assembly defined in claim 4 wherein a plastic frame is connected to the second housing portion.

9. The button controller assembly defined in claim 8 further comprising engagement structures that comprise plastic snaps on the first housing portion that engage portions of a frame while allowing the first and second housing portions to float with respect to each other.

10. The button controller assembly defined in claim 1 wherein at least one of the first and second housing portions comprises double-shot plastic having different first and second plastic portions.

11. The button controller assembly defined in claim 10 wherein the first and second plastic portions comprise plastics of different colors and wherein the first plastic portion is aligned with the first button actuation region in which user button presses result in actuation of the first switch and wherein the second plastic portion is aligned with the second button actuation region in which user button presses result in actuation of the second switch.

12. The button controller assembly defined in claim 11 wherein the second plastic portion has a recessed surface.

13. The button controller assembly defined in claim 10 wherein the first housing portion flexes in addition to floating with respect to the second housing portion when the button controller assembly is squeezed by a user to actuate a given one of the switches.

14. The button controller assembly defined in claim 1 further comprising elastomeric spring members that bias the first and second housing portions apart.

15. The button controller assembly defined in claim 14 wherein the first and second housing portions comprise mating plastic portions that define an elongated button controller assembly housing and wherein the elastomeric spring members are located at opposing ends of the button controller assembly housing.

16. The button controller assembly defined in claim 1 further comprising at least one integrated circuit mounted on a printed circuit board, wherein the switches are mounted on the printed circuit board.

17. The button controller assembly defined in claim 1, wherein the first housing portion comprises at least three distinct regions.

18. The button controller assembly defined in claim 1, further comprising an air gap located between the first and second housing portions.

19. The button controller assembly defined in claim 18, wherein the user squeezing the first and second housing portions together reduces the air gap.

20. The button controller assembly defined in claim 18, further comprising a microphone located in the interior of the button control assembly operable to receive audio signals via the air gap.

* * * * *